US010267018B2

(12) United States Patent
Benson et al.

(10) Patent No.: US 10,267,018 B2
(45) Date of Patent: Apr. 23, 2019

(54) WORK VEHICLE LOAD CONTROL SYSTEM AND METHOD

(71) Applicant: Deere & Company, Moline, IL (US)

(72) Inventors: Christopher R. Benson, Asbury, IA (US); Jeffery Dobchuk, Saskatoon (CA)

(73) Assignee: DEERE & COMPANY, Moline, IL (US)

( * ) Notice: Subject to any disclaimer, the term of this patent is extended or adjusted under 35 U.S.C. 154(b) by 78 days.

(21) Appl. No.: 15/417,954

(22) Filed: Jan. 27, 2017

(65) Prior Publication Data

US 2018/0216315 A1 Aug. 2, 2018

(51) Int. Cl.

| | |
|---|---|
| ***E02F 3/76*** | (2006.01) |
| ***E02F 3/84*** | (2006.01) |
| ***E02F 9/20*** | (2006.01) |

(52) U.S. Cl.

CPC ..... *E02F 9/2029* (2013.01); *E02F 3/844* (2013.01); *E02F 9/2041* (2013.01); *E02F 9/2066* (2013.01); *E02F 3/7609* (2013.01)

(58) Field of Classification Search

CPC ..... E02F 9/2029; E02F 3/844; E02F 9/2041; E02F 9/2246; E02F 3/7609

See application file for complete search history.

(56) References Cited

U.S. PATENT DOCUMENTS

| | | | | |
|---|---|---|---|---|
| 4,846,283 | A * | 7/1989 | Batcheller | A01B 63/112 172/10 |
| 5,297,649 | A * | 3/1994 | Yamamoto | E02F 9/2246 172/3 |
| 5,555,942 | A | 9/1996 | Matsushita et al. | |
| 5,694,317 | A | 12/1997 | Nakagami et al. | |
| 5,699,248 | A | 12/1997 | Nakagami et al. | |
| 5,816,335 | A | 10/1998 | Yamamoto et al. | |
| 5,875,854 | A | 3/1999 | Yamamoto et al. | |
| 5,950,141 | A | 9/1999 | Yamamoto et al. | |
| 5,984,018 | A | 11/1999 | Yamamoto et al. | |
| 6,181,999 | B1 | 1/2001 | Yamamoto et al. | |
| 7,121,355 | B2 | 10/2006 | Lumpkins et al. | |

(Continued)

OTHER PUBLICATIONS

Madeline Oglesby et al., SmartGradeTM Theory of Operation—DG-TX-NA-CRWL-9000-SmartGrade Design Guideline, Deere & Company, Nov. 24, 2015.

(Continued)

*Primary Examiner* — Nicholas Kiswanto

(74) *Attorney, Agent, or Firm* — Klintworth & Rozenblat IP LLP

(57) ABSTRACT

Systems and methods are provided for adjusting a position of an implement of a work vehicle to control a load on the work vehicle. The implement is movable by a hydraulic circuit controlled by a Grade Control System. The method includes: determining, by a processor of the work vehicle, a slip condition associated with the work vehicle; determining, by the processor, an engine speed condition associated with the work vehicle; determining, by the processor, an offset to adjust the position of the implement based on at least one of the slip condition and the engine speed condition; and outputting the offset to the Grade Control System to adjust the position of the implement based on the offset to control the load on the work vehicle.

13 Claims, 5 Drawing Sheets

(56) References Cited

U.S. PATENT DOCUMENTS

| | | | | |
|---|---|---|---|---|
| 8,406,963 | B2 | 3/2013 | Farmer et al. | |
| 8,463,507 | B2 * | 6/2013 | Ekvall | B60W 10/103 701/50 |
| 8,548,690 | B2 | 10/2013 | Hayashi | |
| 8,548,691 | B2 | 10/2013 | Hayashi et al. | |
| 8,649,944 | B2 | 2/2014 | Hayashi et al. | |
| 8,655,556 | B2 | 2/2014 | Hayashi et al. | |
| 8,700,273 | B2 | 4/2014 | Farmer et al. | |
| 8,731,784 | B2 | 5/2014 | Hayashi et al. | |
| 8,762,010 | B2 | 6/2014 | Farmer et al. | |
| 8,770,307 | B2 | 7/2014 | Hayashi et al. | |
| 8,924,095 | B2 | 12/2014 | Fehr et al. | |
| 8,948,977 | B2 | 2/2015 | Liu et al. | |
| 8,948,978 | B2 | 2/2015 | Liu et al. | |
| 8,965,639 | B2 | 2/2015 | Liu et al. | |
| 8,983,739 | B2 | 3/2015 | Faivre | |
| 2011/0153170 | A1 | 6/2011 | Dishman et al. | |
| 2013/0158818 | A1 | 6/2013 | Callaway | |
| 2013/0158819 | A1 | 6/2013 | Callaway | |
| 2014/0257646 | A1 | 9/2014 | Ishibashi et al. | |
| 2015/0019086 | A1 | 1/2015 | Hayashi et al. | |
| 2017/0002540 | A1 * | 1/2017 | Fletcher | E02F 9/2041 |

OTHER PUBLICATIONS

John Deere, 550K/650/700K Crawler Dozers 69-97-kW (92-130hp), JohnDeere.com, Jan. 20, 2016.

John Deere, 700K SmartGradeDozer 97-kW (130 net hp), JohnDeere.com, Jan. 2016.

* cited by examiner

WORK VEHICLE LOAD CONTROL SYSTEM AND METHOD

CROSS-REFERENCE TO RELATED APPLICATION(S)

Not applicable.

STATEMENT OF FEDERALLY SPONSORED RESEARCH OR DEVELOPMENT

Not applicable.

FIELD OF THE DISCLOSURE

This disclosure relates to work vehicles and to a system and method that adjusts a position of an implement of a work vehicle to control a load on the work vehicle.

BACKGROUND OF THE DISCLOSURE

In the construction industry (and others), various work vehicles are operated to perform various tasks at a work site. For example, crawler dozers (hereafter "dozers"), motor graders (hereafter "graders"), and other bladed work vehicles are well-suited for spreading, shearing, carrying, and otherwise moving relatively large volumes of earth. Bladed work vehicles are now commonly equipped with blade actuation systems enabling an operator to manipulate a work vehicle's blade in multiple degrees of freedom (DOFs). In the case of a crawler dozer, for example, an operator may be able to adjust the height, pitch, and rotational angle of the blade through an electro-hydraulic blade actuation system, which is integrated into a blade control assembly mounting the blade to a forward portion of the crawler dozer. Such multi-DOF blade movement provides a powerful and flexible tool in earthmoving operations. However, as the freedom of blade movement increases, so too does the complexity of the operator controls utilized to control blade movement. This, in turn, provides greater opportunities for sub-optimal positioning of the blade and increases the mental workload placed on an operator of the bladed work vehicle.

Advanced Grade Control Systems (GCSs) have been developed for automatically controlling the blade of the crawler dozer, which reduce operator workload. These GCS systems generally control a movement of the blade, including the blade height and cut depth, to arrive at a desired grade. These GCSs, however, may not take into account other factors associated with the crawler dozer during movement of the blade, for example, instances in which the crawler dozer is slipping due to a load acting on the blade. In these instances, the GCSs may continue to lower the blade, which may result in an increased load on the crawler dozer and the crawler dozer slipping further. The increased load on the crawler dozer may damage the crawler dozer, and may create an unsatisfactory work environment for the operator.

SUMMARY OF THE DISCLOSURE

The disclosure provides a system and method for adjusting a position of a blade of work vehicle, such as a crawler dozer, grader and so on, to control a load on the work vehicle.

In one aspect the disclosure provides a method for adjusting a position of an implement of a work vehicle to control a load on the work vehicle. The implement is movable by a hydraulic circuit controlled by a Grade Control System. The method includes: determining, by a processor of the work vehicle, a slip condition associated with the work vehicle; determining, by the processor, an engine speed condition associated with the work vehicle; determining, by the processor, an offset to adjust the position of the implement based on at least one of the slip condition and the engine speed condition; and outputting the offset to the Grade Control System to adjust the position of the implement based on the offset to control the load on the work vehicle.

In another aspect, the disclosure provides a system for adjusting a position of an implement of a work vehicle to control a load on the work vehicle. The implement is movable by a hydraulic circuit controlled by a Grade Control System. The system includes a controller associated with the work vehicle and having a processor that: determines a slip condition associated with the work vehicle; determines an engine speed condition associated with the work vehicle; determines an offset to adjust the position of the implement based on the slip condition or the engine speed condition; and outputs the offset to the Grade Control System associated with the work vehicle to adjust the position of the implement to control the load on the work vehicle.

In another aspect, the disclosure provides a system for adjusting a position of an implement of a work vehicle to control a load on the work vehicle. The implement is movable by a hydraulic circuit controlled by a Grade Control System, the work vehicle having one or more tracks that are driven to move the work vehicle. The system includes a controller associated with the work vehicle and having a processor that: determines a slip condition associated with the work vehicle based on a difference between a ground speed of the work vehicle and a speed of a motor associated with at least one of the tracks; determines an engine speed condition associated with the work vehicle; determines an offset to adjust the position of the implement based on the slip condition or the engine speed condition; and outputs the offset to the Grade Control System to adjust the position of the implement to control the load on the work vehicle.

The details of one or more embodiments are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION

Figure 1:
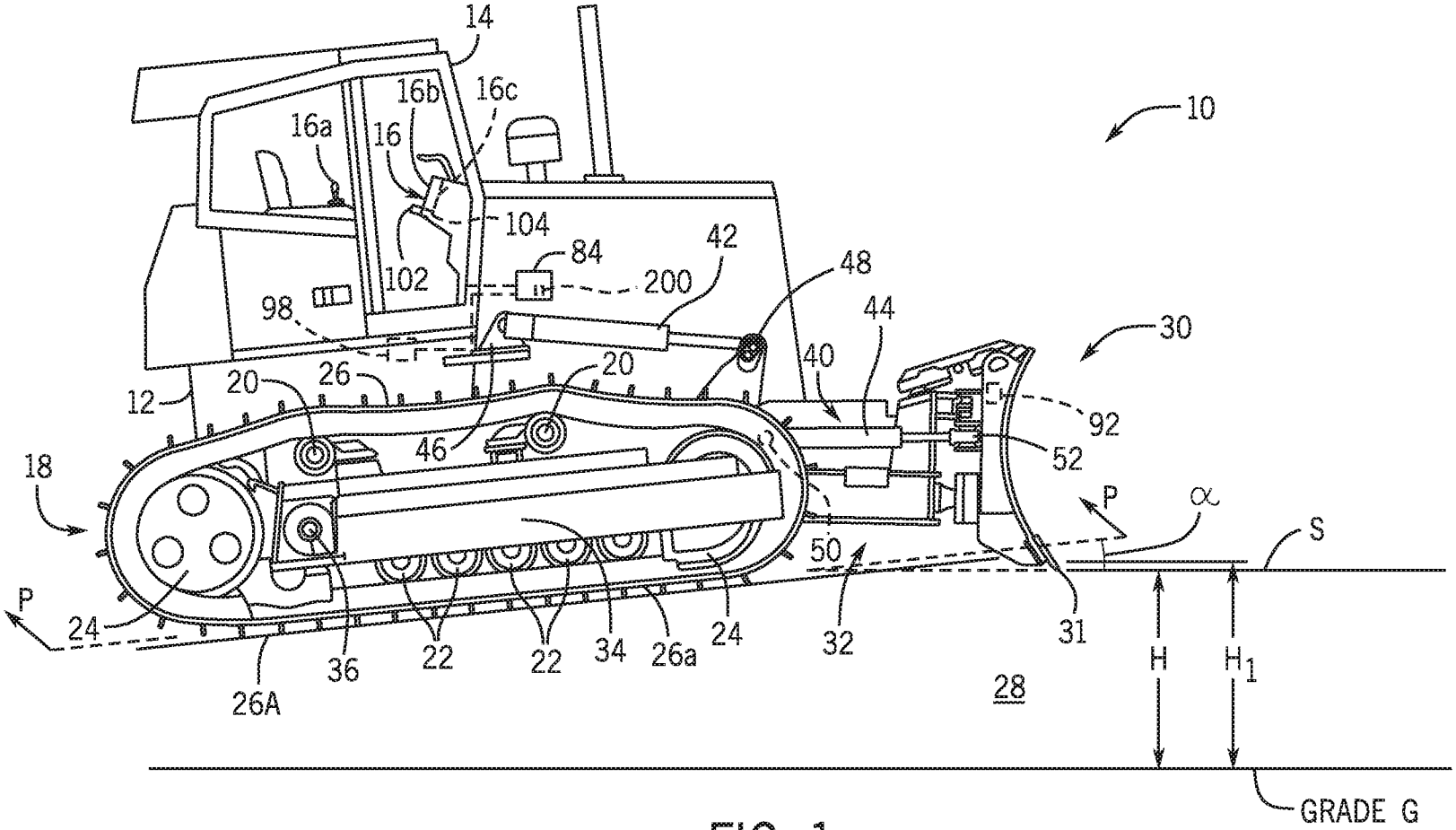
FIG. 1 is a side view of an example work vehicle in the form of a crawler dozer including a blade control linkage, in which the disclosed load control system and method may be used.

The following describes one or more example embodiments of the disclosed system and method, as shown in the accompanying figures of the drawings described briefly above. Various modifications to the example embodiments may be contemplated by one of skill in the art.

As used herein, unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

As used herein, the term module refers to any hardware, software, firmware, electronic control component, processing logic, and/or processor device, individually or in any combination, including without limitation: application specific integrated circuit (ASIC), an electronic circuit, a processor (shared, dedicated, or group) and memory that executes one or more software or firmware programs, a combinational logic circuit, and/or other suitable components that provide the described functionality.

Embodiments of the present disclosure may be described herein in terms of functional and/or logical block components and various processing steps. It should be appreciated that such block components may be realized by any number of hardware, software, and/or firmware components configured to perform the specified functions. For example, an embodiment of the present disclosure may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments of the present disclosure may be practiced in conjunction with any number of work vehicles, and that the crawler dozer described herein are merely one exemplary embodiment of the present disclosure.

For the sake of brevity, conventional techniques related to signal processing, data transmission, signaling, control, and other functional aspects of the systems (and the individual operating components of the systems) may not be described in detail herein. Furthermore, the connecting lines shown in the various figures contained herein are intended to represent example functional relationships and/or physical couplings between the various elements. It should be noted that many alternative or additional functional relationships or physical connections may be present in an embodiment of the present disclosure.

The following describes one or more example implementations of the disclosed system and method for adjusting a position of an implement of a work vehicle, such as a blade of a crawler dozer, to control a load on the work vehicle as shown in the accompanying figures of the drawings described briefly above. Discussion herein may sometimes focus on the example application of the load control system and method for a crawler dozer. In other applications, other configurations are also possible. For example, work vehicles in some embodiments may be configured as various bladed work vehicles, including graders, skid-steer loaders or similar machines. Further, work vehicles may be configured as machines other than construction vehicles, including machines from the agriculture, forestry and mining industries, such as tractors having a bladed implement, and so on. Thus, the configuration of the load control system and method for use with a crawler dozer is merely an example.

When utilized to perform a grading operation or similar task, the work performed with the crawler dozer may be divided into multiple operational phases. These phases may include a loading phase, a carry phase, an offloading or "shedding" phase, and a return phase. During the loading phase, the crawler dozer is controlled by a Grade Control System (GCS) such that the blade penetrates into the ground (or other material) to a desired cut depth at a desired height above a grade. Generally, the grade for the land is predefined by the operator prior to the grading operation. During loading, forward movement of the crawler dozer will typically be primarily resisted by the forces required to shear or dislodge earth and introduce the displaced earth into the volume of loose material pushed by the blade of the crawler dozer.

After the crawler dozer completes a given loading phase, the blade is typically lifted such that little to no additional earth is sheared from the ground. The crawler dozer thus enters the carry phase. After pushing the pile (FIG. 1) to its desired destination, the crawler dozer disengages from the pile (the shedding phase). The crawler dozer is then repositioned to perform another pass (the return phase), the blade is again lowered into the earth, and the crawler dozer reenters the loading phase. The previously-described work cycle is then repeated.

While the crawler dozer is illustrated in FIG. 1 as traveling on an incline, it will be understood that the load control system and method as described herein is applicable to all movements of the crawler dozer while the GCS is active, and not just to movements of the crawler dozer on an incline. Generally, when the GCS is active, the GCS is automatically moving and adjusting the blade to cut the earth (or other material) to arrive at the grade G. In certain instances, due to the resistance of the pile, for example, a load applied to the crawler dozer may cause the crawler dozer to slip or may cause an increase in an operating speed of an engine of the crawler dozer in order to move the blade. Typically, the GCS is unaware of the slip condition or change in engine operating speed of the crawler dozer, and will continue to command the blade downward to achieve the desired grade G. This continued downward movement of the blade will increase the load applied to the crawler dozer, and may damage the crawler dozer and/or the blade. It may also result in an unsafe operating environment for the operator.

Generally, the disclosed systems and methods (and work vehicles in which they are implemented, such as the crawler dozer) provide for load control on the work vehicle as compared to conventional systems by outputting an offset to the GCS to adjust a position of the blade to a height that is greater than a commanded height for the cutting edge of the blade by the GCS. By outputting the offset to adjust the position of the blade to the height that is offset from the commanded height for the blade by the GCS, the load on the crawler dozer is reduced as the blade is pushing against a pile of a reduced size or thickness.

In one example, the load control system and method cooperates with the GCS to reduce the load acting on the crawler dozer. Generally, the load control system and method determines an offset for adjusting a position of the blade, such as a height of the blade, relative to the height of the blade commanded by the GCS to reduce the load acting on the crawler dozer, and the load control system and method outputs this offset to the GCS. On receipt of the offset, the GCS adjusts a position of the blade by raising the blade to a height that is the commanded height plus the offset, thereby reducing the load acting on the crawler dozer. In various embodiments, the load control system and method determines the offset based on at least one of a determined slip condition for the crawler dozer and one or more of an engine speed condition.

As noted above, the disclosed load control system and method may be utilized with regard to various work vehicles, including crawler dozers, graders, tractors with bladed implements, skid-steer loaders etc. Referring to FIG. 1, in some embodiments, the disclosed load control system may be used with a work vehicle, such as a crawler dozer 10, to adjust an implement of the crawler dozer 10 to control a load acting on the crawler dozer 10.

In the embodiment depicted, the crawler dozer 10 includes a chassis 12, a cab 14 supported by the chassis 12, and a number of operator controls 16 located within the cab 14. The operator controls 16 includes one or more joysticks, such as the joystick 16*a*, various switches or levers, one or more buttons, a touchscreen interface 16*b* that may be overlaid on a display 16*c*, a keyboard, a speaker, a microphone associated with a speech recognition system, control pedals, or various other human-machine interface devices. The operator may actuate one or more devices of operator controls 16 for purposes of operating the crawler dozer 10, and for providing input to the anti-bridging system and method of the disclosure. For example, the input received to the joystick 16*a* commands the crawler dozer 10 to enter one of various operating states, such as a dozing state, a load level state, etc. The input received to the touchscreen interface 16*b* may provide one or more user-selected or user-defined rates for an adjustment of the blade 30, with each user-selected or user-defined rate associated with each one of the operating states of the crawler dozer 10. In this example, the operator controls 16 also includes a throttle control, such as a throttle control knob 102, which receives operator input to command an engine speed for the crawler dozer 10.

The crawler dozer 10 further includes a tracked undercarriage 18 containing top rollers 20, bottom rollers 22, sprockets and/or idlers 24, and twin tracks 26. In further embodiments, the tracked undercarriage 18 can be replaced by a different type of undercarriage including wheels, friction or positively-driven belts, or another ground-engaging mechanism suitable for moving the crawler dozer 10 across a tract of land, such as off-road terrain 28, to cut a grade G identified in FIG. 1. In certain instances, the blade 30 of the crawler dozer 10 may make multiple passes across a surface S to reach the desired grade G.

The crawler dozer 10 further includes a blade 30 having a lower cutting edge 31. The blade 30 is mounted to a forward portion of the chassis 12 by an outer blade control linkage 32, which is constructed of various links, joints, and other structural elements. The blade control linkage 32 may include, for example, a push frame 34 joined to tracked undercarriage 18 at pivot points 36. A blade actuation system 40 is further provided, the components of which may be generally interspersed or integrated with the components of the blade control linkage 32. The blade actuation system 40 can include any number and type of actuators suitable for enabling an operator of the crawler dozer 10 to control the position of the blade 30 relative to the chassis 12. In the illustrated example, the blade actuation system 40 includes two hydraulic lift cylinders 42 (only one of which can be seen in FIG. 1) and two hydraulic pitch cylinders 44 (again only one of which can be seen). The hydraulic lift cylinders 42 are each pivotally coupled to chassis 12 at a first pivot point 46 and further pivotally coupled to blade 30 at a second pivot point 48 such that extension and retraction of the hydraulic lift cylinders 42 raises or lowers the blade 30. Similarly, the hydraulic pitch cylinders 44 are each pivotally coupled to the push frame 34 at a first pivot point 50 and further pivotally coupled to blade 30 at a second pivot point 52 such that extension and retraction of the hydraulic pitch cylinders 44 adjusts the pitch of the blade 30. In certain cases, it may also be possible to adjust the tilt angle of the blade 30 by commanding the hydraulic pitch cylinders 44 to different stroke positions; e.g., by extending one of the hydraulic pitch cylinders 44, while simultaneously retracting the other hydraulic pitch cylinder 44.

As indicated above, the blade control linkage 32 and the blade actuation system 40 shown in FIG. 1 are provided purely by way of non-limiting example. In further embodiments of the crawler dozer 10, the blade control linkage 32 and the blade actuation system 40 can vary such that movement of the blade 30 may be controlled in a different manner. For example, in another embodiment, the blade actuation system 40 may include a single hydraulic pitch cylinder 44, which can be extended or retracted to adjust the blade 30. Additionally, a non-hydraulic, manual mechanism may also be provided for adjusting blade pitch in certain embodiments. Generally, then, it should be understood that the blade control linkage 32 and the blade actuation system 40 can assume any form enabling the height and/or pitch of the blade 30 to be remotely controlled utilizing the operator controls 16 and automatically adjusted by one or more systems onboard the crawler dozer 10, such as a GCS 88 in the manner described more fully below.

Figure 2:
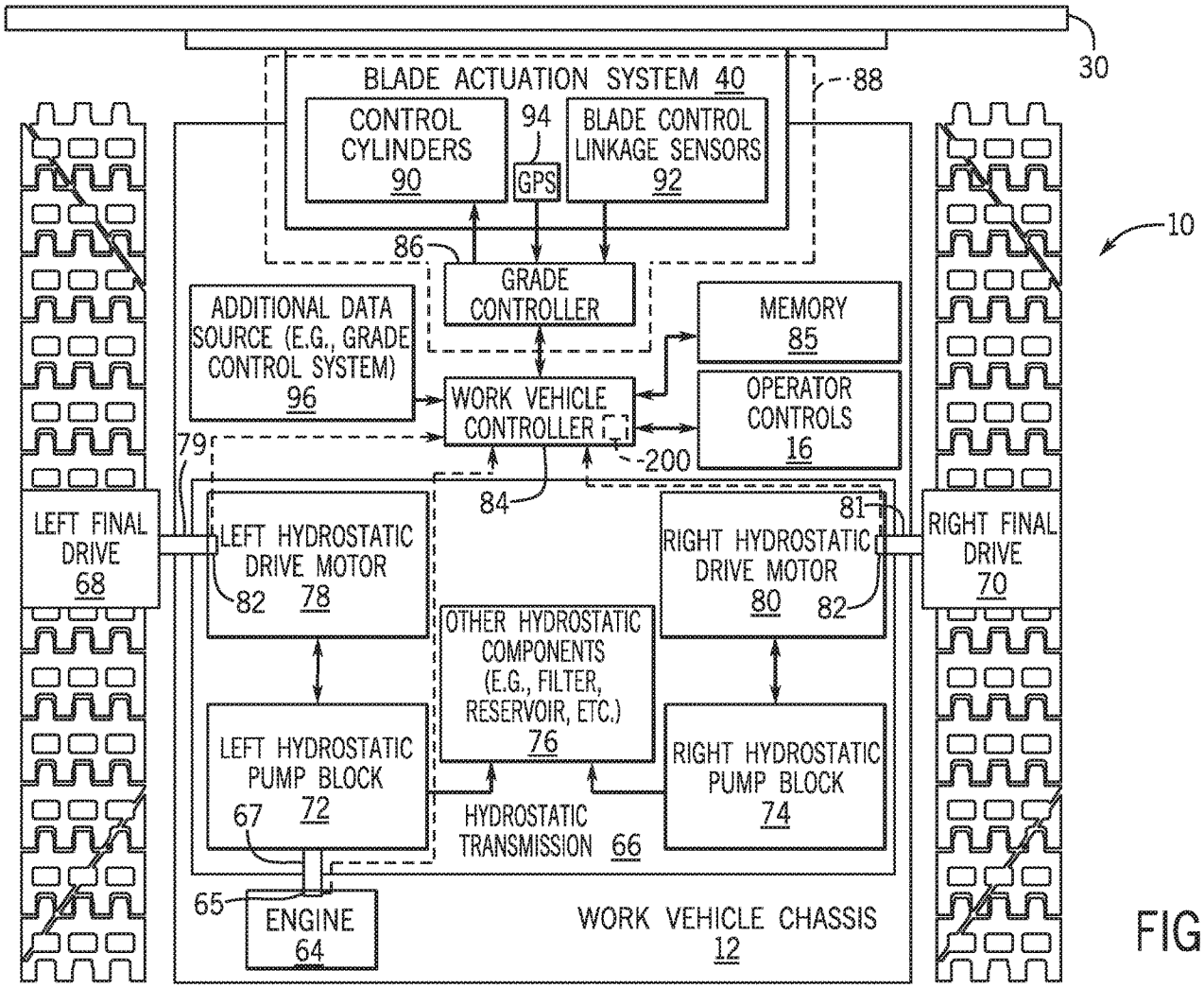
FIG. 2 is a schematic representation of the example crawler dozer shown in FIG. 1, which includes the load control system.

Advancing now to FIG. 2, a schematic of the example crawler dozer 10 is shown. Here, it can be seen that the crawler dozer 10 includes a number of additional components beyond those previously described in conjunction with FIG. 1. Such additional components can include, for example, an engine 64 (e.g., a diesel engine), a hydrostatic transmission 66, a left final drive 68, and a right final drive 70. During operation of the crawler dozer 10, the engine 64 drives rotation of the tracks 26 through the hydrostatic transmission 66 and the final drives 68, 70. In one example, the rotating mechanical output of the engine 64 drives left and right hydrostatic pumps 72, 74 that may be included within the hydrostatic transmission 66. The hydrostatic pumps 72, 74 are fluidly interconnected through other fluid-conducting components 76 of the hydrostatic transmission 66, such as filters, reservoirs, heat exchangers, and the like. The hydrostatic pumps 72, 74 are further fluidly coupled to and drive hydrostatic motors 78, 80 contained with the hydrostatic transmission 66. The mechanical output shafts 79, 81 of the hydrostatic motors 78, 80 then drive rotation of sprockets engaging the tracks 26 through the final drives 68, 70. The engine and the powertrain of the crawler dozer 10 (or other bladed work vehicles described herein) may vary in other embodiments.

At least one engine speed sensor 65 is associated with the engine 64. The engine speed sensor 65 observes an operational speed of the engine 64, such as a rotational speed of an output shaft 67 associated with the engine 64, and generates sensor signals based on this observation. Thus, during operation of the crawler dozer 10, the engine speed sensor 65 observes the output shaft 67 associated with the engine 64 and generates sensor signals or sensor data based thereon, which is communicated to a work vehicle controller 84 onboard the crawler dozer 10. For example, the engine speed sensor 65 observes a rotational speed of the output shaft 67 and generates sensor signals based thereon, which may be received and processed by the work vehicle controller 84 to determine a speed of the engine 64.

One or more hydrostatic drive motor sensors 82 are further included in the hydrostatic motors 78, 80. The hydrostatic drive motor sensors 82 each include a sensor for monitoring a speed of the respective output shaft 79, 81 of the hydrostatic motors 78, 80. During operation of the crawler dozer 10, the hydrostatic drive motor sensors 82 observe the output shafts 79, 81 associated with the hydrostatic motors 78, 80 and generate sensor signals or sensor data based thereon, which is communicated to the work vehicle controller 84 onboard the crawler dozer 10. For example, the hydrostatic drive motor sensors 82 observe a rotational speed of the output shafts 79, 81 and generate sensor signals based thereon, which may be received and processed by the work vehicle controller 84 to determine a speed of each of the hydrostatic motors 78, 80.

The one or more controllers are schematically represented in FIG. 2 by a single block "84" and will be referred to as "work vehicle controller 84" hereafter for ease of reference. It will be noted, however, that the work vehicle controller 84 can include any number of processing devices, which can be distributed throughout the crawler dozer 10 and interconnected utilizing different communication protocols and memory architectures.

Generally, the work vehicle controller 84 (or multiple controllers) may be provided, for control of various aspects of the operation of the crawler dozer 10, in general. The work vehicle controller 84 (or others) may be configured as a computing device with associated processor devices and memory architectures 85, as a hard-wired computing circuit (or circuits), as a programmable circuit, as a hydraulic, electrical or electro-hydraulic controller, or otherwise. As such, the work vehicle controller 84 may be configured to execute various computational and control functionality with respect to the crawler dozer 10 (or other machinery). In some embodiments, the work vehicle controller 84 may be configured to receive input signals in various formats (e.g., as hydraulic signals, voltage signals, current signals, and so on), and to output command signals in various formats (e.g., as hydraulic signals, voltage signals, current signals, mechanical movements, and so on). In some embodiments, the work vehicle controller 84 (or a portion thereof) may be configured as an assembly of hydraulic components (e.g., valves, flow lines, pistons and cylinders, and so on), such that control of various devices (e.g., pumps or motors) may be effected with, and based upon, hydraulic, mechanical, or other signals and movements.

The work vehicle controller 84 may be in electronic, hydraulic, mechanical, or other communication with various other systems or devices of the crawler dozer 10 (or other machinery). For example, the work vehicle controller 84 may be in electronic or hydraulic communication with various actuators, sensors, and other devices within (or outside of) the crawler dozer 10, including various devices associated with the hydrostatic pumps 72, 74, components 76, engine speed sensor 65, GCS 88, hydrostatic motors 78, 80, hydrostatic drive motor sensors 82, blade control linkage sensors 92, additional data sources 96 and so on. The work vehicle controller 84 may communicate with other systems or devices in various known ways, including via a CAN bus (not shown) of the crawler dozer 10, via wireless or hydraulic communication means, or otherwise. An example location for the work vehicle controller 84 is depicted in FIGS. 1 and 2. It will be understood, however, that other locations are possible including other locations on the crawler dozer 10, or various remote locations. The work vehicle controller 84 receives input commands and interacts with the operator via the operator controls 16, such as the throttle control knob 102, the joystick 16*a* and the touchscreen 16*b*.

As noted above, crawler dozer 10 further includes the blade actuation system 40. In one example, the blade actuation system 40 is controlled by a grade controller 86 of the GCS 88. The blade actuation system 40 contains a number of blade control linkage cylinders 90 and blade control linkage sensors 92. As schematically illustrated in FIG. 2, the blade control linkage cylinders 90 encompass the hydraulic lift cylinders 42 and the hydraulic pitch cylinders 44 described above in conjunction with FIG. 1. The grade controller 86 is further operably coupled to the blade control linkage cylinders 90 and can transmit commands thereto. The grade controller 86 may transmit such commands to the blade control linkage cylinders 90 in accordance with operator input received via the operator controls 16 and communicated to the grade controller 86 by the work vehicle controller 84, or in response to automatic blade adjustments determined by the grade controller 86 of the GCS 88.

The blade control linkage sensors 92 observe a condition associated with the blade 30, for example, a position of the blade 30, such as a pitch and a height of the blade 30 relative to gravity, and generate sensor signals or sensor data based on the observation. The blade control linkage sensors 92 communicate these sensor signals to the grade controller 86, which processes these sensor signals and outputs data for the work vehicle controller 84. Generally, the blade control linkage sensors 92 may include various different combinations of force sensors (e.g., load cells) for measuring the forces applied through the blade 30 and the blade control linkage 32, positional sensors (e.g., magnetostrictive linear position sensors) for measuring the stroke of any or all of the blade control linkage cylinders 90, vibration sensors, wear sensors, and/or various other sensors for monitoring the operational parameters of the blade actuation system 40, including one or more cameras, depth sensors, etc. In one example, the blade control linkage sensors 92 comprise one or more inertial measurement units (IMUs) that observe a linear and an angular position of the blade 30 relative to gravity and generate sensor signals based thereon.

The grade controller 86 of the GCS 88 may be configured as a computing device with associated processor devices and memory architectures, as a hard-wired computing circuit (or circuits), as a programmable circuit, as a hydraulic, electrical or electro-hydraulic controller, or otherwise. As such, the grade controller 86 may be configured to execute various computational and control functionality with respect to the crawler dozer 10 (or other machinery). In some embodiments, the grade controller 86 may be configured to receive input signals in various formats (e.g., as hydraulic signals, voltage signals, current signals, and so on), and to output command signals in various formats (e.g., as hydraulic signals, voltage signals, current signals, mechanical movements, and so on). In some embodiments, the grade controller 86 (or a portion thereof) may be configured as an assembly of hydraulic components (e.g., valves, flow lines, pistons and cylinders, and so on), such that control of various devices (e.g., pumps or motors) may be effected with, and based upon, hydraulic, mechanical, or other signals and movements. The grade controller 86 may be in electronic, hydraulic, mechanical, or other communication with various other systems or devices of the crawler dozer 10 (or other machinery). For example, the grade controller 86 may be in electronic or hydraulic communication with various actuators, sensors, and other devices within (or outside of) the crawler dozer 10, including a Global Positioning System (GPS) 94, the blade control linkage cylinders 90 and the blade control linkage sensors 92. The grade controller 86 may communicate with other systems or devices in various known ways, including via a CAN bus (not shown) of the crawler dozer 10, via wireless or hydraulic communication means, or otherwise. An example location for the grade controller 86 is depicted in FIG. 2. It will be understood, however, that other locations are possible including other locations on the crawler dozer 10, or various remote locations. The grade controller 86 is in communication with the work vehicle controller 84 over a suitable communication architecture, such as the CAN bus associated with the crawler dozer 10.

The work vehicle controller 84 may also receive data inputs from additional data sources 96, which are further coupled to one or more inputs of the work vehicle controller 84 and which can be distributed across the infrastructure of the example crawler dozer 10. The additional data sources 96 can include any number of sensors generating data that may be utilized by the work vehicle controller 84 in performing embodiments of the below-described load control system. In one example, one or more of these sensors are associated with the GCS 88. For example, such additional data sources 96 can include, for example, crawler dozer position data and ground speed data received from the GPS 94 included in the GCS 88 installed on the crawler dozer 10. The additional data sources 96 also include an active signal, which may be received by the work vehicle controller 84 when the GCS 88 is actively controlling the movement of the blade 30.

In addition, the work vehicle controller 84 receives one or more inputs from the operator controls 16. For example, the operator controls 16 includes the throttle control knob 102, and a throttle control sensor 104 may observe a rotary position of the throttle control knob 102 and generate sensor signals or sensor data based on the observation. The throttle control sensor 104 is generally a rotary position sensor, including, but not limited to, a rotary encoder and so on.

The various components noted above (or others) may be utilized to adjust a position of the blade 30 to reduce a load on the crawler dozer 10 via control of the movement of the one or more blade control linkage cylinders 90. Accordingly, these components may be viewed as forming part of the load control system for the crawler dozer 10. Each of the sensors 65, 82, 92, 104, the GPS 94, the GCS 88, the grade controller 86 and the operator controls 16 are in communication with the work vehicle controller 84 via a suitable communication architecture, such as a CAN bus.

In various embodiments, the work vehicle controller 84 includes a load control module 200 embedded within the work vehicle controller 84. In various embodiments, the load control module 200 generates an offset for the GCS 88 to move or adjust a position of the blade 30 to reduce a load on the crawler dozer 10 based on sensor signals or sensor data from the sensors 65, 82, 92, 104, data from the GPS 94, data from the additional data sources 96, input data and commands from the operator controls 16 and further based on the load control system and method of the present disclosure.

Figure 3:
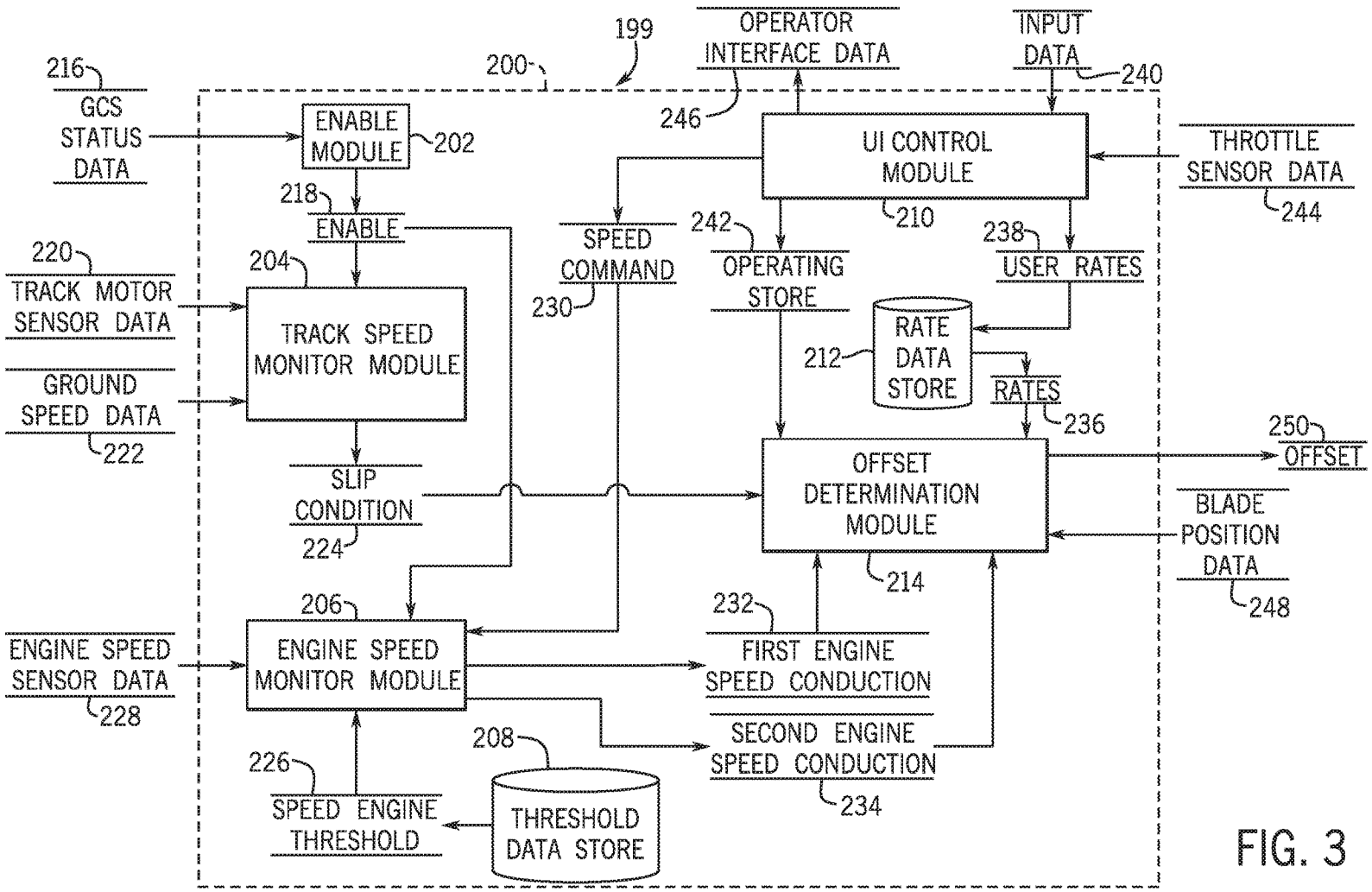
FIG. 3 is a dataflow diagram illustrating an example load control system for the work vehicle of FIG. 1 in accordance with various embodiments.

Referring now also to FIG. 3, a dataflow diagram illustrates various embodiments of a load control system 199 for the crawler dozer 10, which may be embedded within the load control module 200 of the work vehicle controller 84. Various embodiments of the load control system 199 according to the present disclosure may include any number of sub-modules embedded within the work vehicle controller 84. As may be appreciated, the sub-modules shown in FIG. 3 may be combined and/or further partitioned to similarly generate an offset for adjusting a position of the blade 30 by the GCS 88 via control of the blade control linkage cylinders 90, for example, the hydraulic lift cylinders 42. Inputs to the load control system 199 may be received from the operator controls 16, such as the joystick 16*a*, touchscreen 16*b* and the throttle control knob 102 (FIG. 1), received from the sensors 65, 82, 92, 104, received from the GPS 94, received from the additional data sources 96, received from the grade controller 86, received from other control modules (not shown) associated with the crawler dozer 10 and/or determined/modeled by other sub-modules (not shown) within the work vehicle controller 84. In various embodiments, the load control module 200 includes an enable module 202, a track speed monitor module 204, an engine speed monitor module 206, a threshold datastore 208, an operator or user interface (UI) control module 210, a rate datastore 212 and an offset determination module 214.

The enable module 202 receives as input GCS status data 216. In this example, the GCS status data 216 is an active signal received from the grade controller 86. The active signal indicates that the GCS 88 is active. As used herein, the GCS 88 is "active" when the GCS 88 is automatically moving and/or positioning the blade 30 to obtain the grade G (FIG. 1). Based on the receipt of the active signal, the enable module 202 sets enable 218 for each of the track speed monitor module 204 and the engine speed monitor module 206.

Based on receipt of the enable 218, the track speed monitor module 204 receives as input track motor sensor data 220. The track motor sensor data 220 is the sensor signals or sensor data from each of the hydrostatic drive motor sensors 82. The track speed monitor module 204 processes the track motor sensor data 220 and determines a speed of each of the tracks 26 or track speed associated with each one of the tracks 26.

The track speed monitor module 204 also receives as input ground speed data 222. The ground speed data 222 is a ground speed of the crawler dozer 10 as received from the GPS 94 of the GCS 88 (FIG. 2). The track speed monitor module 204 compares the determined speed of each of the tracks 26 (or track speed) to the ground speed. If the track speed monitor module 204 determines a difference between the determined speed of at least one of the tracks 26 and the ground speed, the track speed monitor module 204 sets slip condition 224 for the offset determination module 214. The slip condition 224 is a flag that one or more of the tracks 26 is operating at a speed that is not equal to the ground speed of the crawler dozer 10, for example, at least one of the tracks 26 is slipping. In certain embodiments, the track speed monitor module 204 may also determine if the difference between the determined speed of at least one of the tracks 26 and the ground speed exceeds a predefined threshold, and may set the slip condition 224 if the differences exceeds the predefined threshold.

The threshold datastore 208 stores one or more thresholds for various parameters associated with the operation of the crawler dozer 10. In one example, the threshold datastore 208 stores one or more thresholds that are utilized in determining whether to adjust the blade 30 to control the load on the crawler dozer 10. In this example, the threshold datastore 208 stores a speed error threshold 226. The speed error threshold 226 is a predefined or factory set value associated with a particular crawler dozer 10. In one example, the speed error threshold 226 is a pre-defined threshold value for a difference between a current speed of the engine 64 and a commanded speed of the engine 64.

Based on the receipt of the enable 218, the engine speed monitor module 206 receives as input engine speed sensor data 228. The engine speed sensor data 228 is the one or more sensor signals or sensor data from the engine speed sensor 65. The engine speed monitor module 206 processes the engine speed sensor data 228 and determines a first engine speed. The first engine speed is a current operating speed of the engine 64, as observed during a first sampling of the engine speed sensor 65.

The engine speed monitor module 206 also receives as input a speed command 230 from the UI control module 210. The speed command 230 is the operator commanded target speed for the crawler dozer 10, which is received as input to the throttle control knob 102 of the operator controls 16 as observed by the throttle control sensor 104. Based on the determined first engine speed and the received commanded speed from the throttle control knob 102, the engine speed monitor module 206 calculates a first speed error. The first speed error is the difference between the determined first engine speed and the received commanded speed from the speed command 230.

The engine speed monitor module 206 retrieves the speed error threshold 226 from the threshold datastore 208. The engine speed monitor module 206 compares the first speed error to the speed error threshold 226. If the first speed error is greater than the speed error threshold 226, the engine speed monitor module 206 sets first engine speed condition 232 for the offset determination module 214. The first engine speed condition 232 is a flag that indicates the first speed error is greater than the speed error threshold 226.

If the first speed error is greater than the speed error threshold 226, the engine speed monitor module 206 also receives as input the engine speed sensor data 228. Stated another way, if the first engine speed condition 232 is true (such that the first speed error is greater than the speed error threshold 226), the engine speed monitor module 206 resamples the engine speed sensor 65. The engine speed monitor module 206 determines a second engine speed based on the resampling of the engine speed sensor 65. The engine speed monitor module 206 calculates a second speed error based on the determined second engine speed and the received commanded speed from the speed command 230. The second speed error is the difference between the determined second engine speed and the received commanded speed from the speed command 230.

Based on the first speed error and the second speed error, the engine speed monitor module 206 determines a direction of the speed error rate. Stated another way, the engine speed monitor module 206 compares the first speed error to the second speed error to determine whether the speed error rate is increasing or decreasing. If the direction of the speed error rate is decreasing, such that the speed error rate is decreasing, the engine speed monitor module 206 sets second engine speed condition 234 for the offset determination module 214. The second engine speed condition 234 is a second flag that indicates the speed error rate decreasing.

The rate datastore 212 stores one or more rates, such as adjustment rates, for various parameters associated with the operation of the blade 30 of the crawler dozer 10. In one example, the rate datastore 212 stores at least one rate 236 that is utilized in determining an amount of adjustment for the blade 30 to control the load on the crawler dozer 10. In this example, the rate datastore 212 stores user rates 238, which are user-defined based on input received to the operator controls 16, and default or factory set rates. Generally, each of the rates are associated with a particular operating state for the crawler dozer 10, and thus, the rate datastore 212 may store the rates in a tabular format, which may be indexed according to the various operating states of the crawler dozer 10. Thus, in one example, the rate datastore 212 comprises a look-up table, which is populated based on user input (i.e. user rates 238) or based on predefined default or factory set values.

The UI control module 210 receives input data 240. The input data 240 is the operator input received to the operator controls 16, including, but not limited to the joystick 16*a* and the touchscreen 16*b*. The UI control module 210 processes the input data 240 and sets operating state 242 for the offset determination module 214. The operating state 242 is the current user-selected operating state for the crawler dozer 10 as commanded via input to the joystick 16*a*. The UI control module 210 also processes the input data 240 to identify user-defined rates for the adjustment of the blade 30 that correspond to each of the operating states of the crawler dozer 10. The UI control module 210 stores the user-defined rates as the user rates 238 in the rate datastore 212.

In various embodiments, the UI control module 210 also receives as input throttle sensor data 244. The throttle sensor data 244 is the one or more sensor signals or sensor data from the throttle control sensor 104 that indicate an operator selected or commanded target speed for the engine 64 of the crawler dozer 10. In this example, the UI control module 210 processes the throttle sensor data 244 and sets the speed command 230 for the engine speed monitor module 206. It should be noted that the engine speed monitor module 206 may directly receive and process the throttle sensor data 244, if desired.

The UI control module 210 may also output user or operator interface data 246. The operator interface data 246 is data for rendering one or more user interfaces or operator interfaces on the display 16*c*. For example, the operator interface data 246 provides instructions for rendering one or more textual input boxes, drop down menus, etc. on the display 16*c* to enable receipt of input from the operator to define the one or more user-defined rates for the adjustment of the blade 30.

The offset determination module 214 receives as input the slip condition 224. Based on the slip condition 224, the offset determination module 214 receives as input blade position data 248. The blade position data 248 includes sensor signals or sensor data received from the blade control linkage sensors 92 of the GCS 88 via the grade controller 86.

The offset determination module 214 processes the blade position data 248 and determines a current position or the height H1 of the cutting edge 31 of the blade 30 above the grade G (FIG. 1). Alternatively, the offset determination module 214 may receive the current blade position relative to the grade G from the grade controller 86. Based on the current height of the cutting edge 31 of the blade 30, the offset determination module 214 determines whether the cutting edge 31 is above the grade G or at the grade G (FIG. 1). If the cutting edge 31 is at the grade G, the offset determination module 214 outputs offset 250 as zero.

Otherwise, if the cutting edge 31 of the blade 30 is above the grade G, the offset determination module 214 receives as input the operating state 242 of the crawler dozer 10. Based on the operating state 242, the offset determination module 214 retrieves the rate 236 from the rate datastore 212. Based on the received rate 236, the offset determination module 214 calculates a gain. The gain is a value between 0 and 1. The offset determination module 214 outputs the calculated gain as the offset 250.

The offset determination module 214 outputs the offset 250 to the grade controller 86 of the GCS 88 to adjust the current height of the blade 30 based on the offset 250. Stated another way, the grade controller 86 adds the offset to the current commanded position or height for the blade 30 such that the blade control linkage cylinders 90 (e.g. the hydraulic lift cylinders 42) are commanded to move or adjust the blade 30 to a height H1 that is greater than (offset from) the current height of the blade 30 to cut the grade G as determined by the GCS 88. By moving the blade 30 to the height H1 that is offset from the current position or height of the blade 30 determined by the GCS 88, the load on the crawler dozer 10 is reduced, as the blade 30 is pushing against a reduced amount of material. As used herein, the "current height H" of the blade 30 is the desired position or height for the blade 30 as determined by the grade controller 86 in order to cut the grade G.

Figure 4:
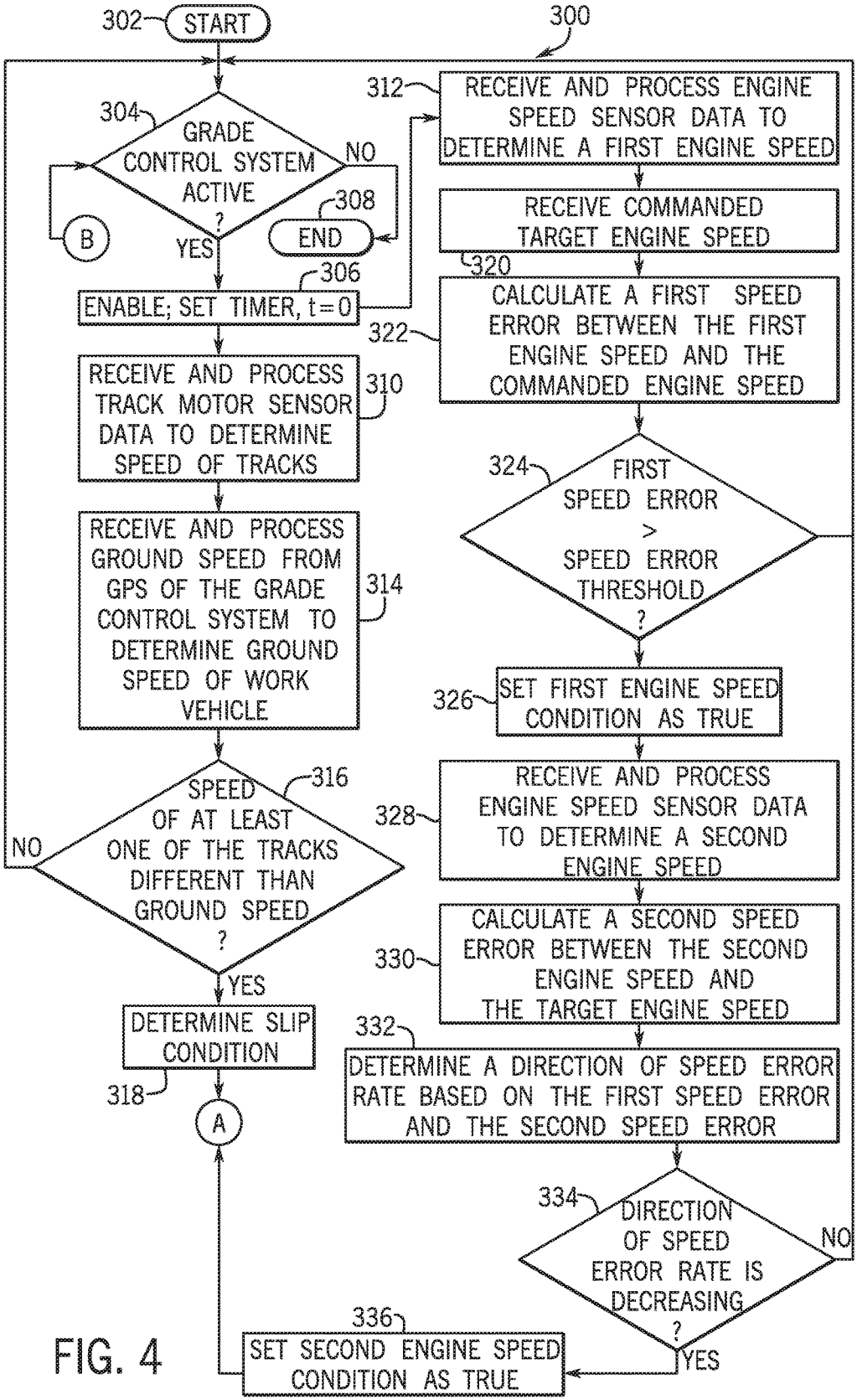
FIG. 4 is a flowchart illustrating a method performed by the load control system of FIG. 3 in accordance with various embodiments.

Referring now also to FIG. 4, a flowchart illustrates a method 300 that may be performed by the work vehicle controller 84 of FIGS. 1-3 in accordance with the present disclosure. As may be appreciated in light of the disclosure, the order of operation within the method is not limited to the sequential execution as illustrated in FIG. 4, but may be performed in one or more varying orders as applicable and in accordance with the present disclosure.

In various embodiments, the method may be scheduled to run based on predetermined events, and/or may run based on a start-up of the crawler dozer 10, for example.

In one example, the method begins at 302. At 304, the method determines whether the GCS 88 is active. In this example, the method processes the GCS status data 216 to determine whether the active signal has been received. If the GCS 88 is active, the method proceeds to 306. Otherwise, the method ends at 308.

At 306, the method sets the enable 218 and sets a timer t equal to zero. The method proceeds to both 310 and 312. It should be noted that while the method is illustrated herein as proceeding to both 310 and 312 substantially simultaneously, the method may proceed to one of 310 or 312. In this example, the method proceeds to 310 to determine whether the slip condition 224 exists, and proceeds to 312 to determine whether one or more engine speed conditions 232, 234 exist.

At 310, the method receives and processes the track motor sensor data 220. The method determines the speed of each of the tracks 26. At 314, the method receives and processes the ground speed data 222 from the GPS 94 of the GCS 88 to determine the ground speed of the crawler dozer 10. At 316, the method determines whether the speed of at least one of the tracks 26 is different than the ground speed of the crawler dozer 10. If true, the method sets the slip condition 224 at 318 and proceeds to A on FIG. 5. If false, the method loops to 304.

At 312, the method receives and processes the engine speed sensor data 228 and determines a first speed of the engine 64 or the first engine speed. At 320, the method receives the commanded target engine speed from the operator controls 16. In one example, the method receives and processes the throttle sensor data 244 to determine the engine speed commanded by the operator via input to the throttle control knob 102. At 322, the method calculates the first speed error based on a difference between the first engine speed and the commanded engine speed. At 324, the method retrieves the speed error threshold 226 from the threshold datastore 208 and determines whether the first speed error is greater than the speed error threshold 226. If true, the method proceeds to 326. If false, the method loops to 304.

At 326, the method sets the first engine speed condition 232 as true. At 328, the method receives and processes the engine speed sensor data 228 to determine a second speed of the engine 64 or second engine speed. At 330, the method calculates the second speed error based on a difference between the second engine speed and the commanded engine speed. At 332, the method determines a direction of the speed error rate based on the first speed error and the second speed error. At 334, the method determines whether the direction of the speed error rate is decreasing. If true, the method proceeds to 336. If false, the method loops to 304. At 336, the method sets the second engine speed condition 234 as true and proceeds to A on FIG. 5.

Figure 5:
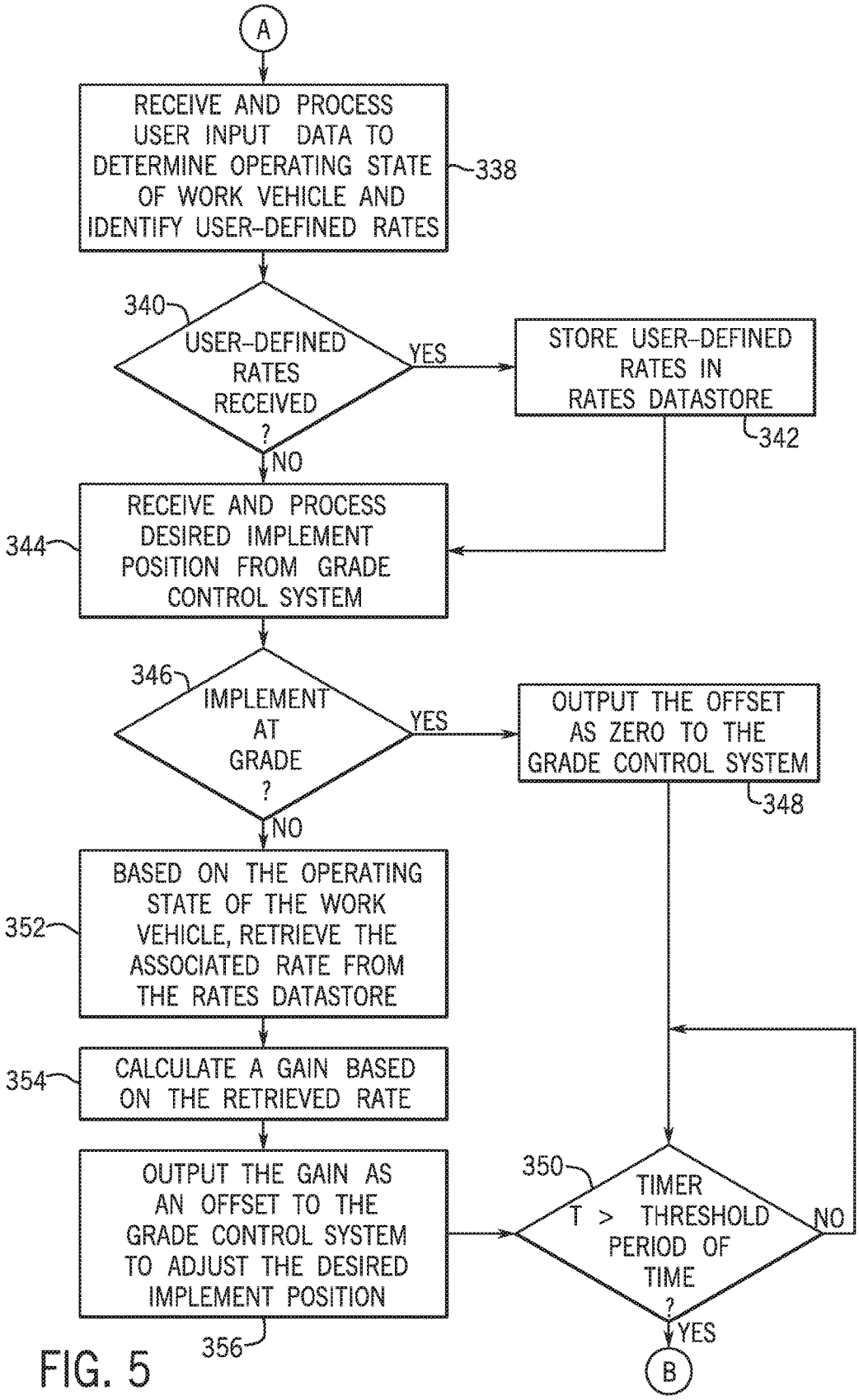
FIG. 5 is a continuation of the flowchart of FIG. 4.

With reference to FIG. 5, from A, at 338, the method receives and processes the input data 240. The method interprets the input data 240 to determine the operating state 242 of the crawler dozer 10 as received via the joystick 16*a*; and to identify one or more user-defined rates. The method determines at 340 whether one or more user-defined rates for the adjustment of the blade 30 has been received in the input data 240. If true, the method stores the user rates 238 in the rate datastore 212 at 342 and proceeds to 344.

Otherwise, at 344, the method receives and processes the desired implement position or current height H of the cutting edge 31 of the blade 30 from the grade controller 86 of the GCS 88. At 346, the method determines whether the blade 30 is at the grade G. If true, at 348, the method outputs the offset 250 as zero to the GCS 88 and the method proceeds to 350.

Otherwise, at 352, based on the operating state 242 of the crawler dozer 10, the method retrieves the rate 236 from the rate datastore 212 that is associated with the operating state 242. At 354, the method calculates a gain based on the retrieved rate 236. At 356, the method outputs the gain as the offset 250 to the GCS 88 to adjust the desired or current position of the blade 30 to a position that is the current commanded position plus the offset 250.

At 350, the method determines whether the timer t is greater than a threshold period of time. In one example, the threshold period of time is about 5 minutes. If true, the method proceeds to B on FIG. 4. Otherwise, the method loops. The value for the threshold period of time may be stored in and retrieved from the threshold datastore 208.

As will be appreciated by one skilled in the art, certain aspects of the disclosed subject matter may be embodied as a method, system (e.g., a work vehicle control system included in a work vehicle), or computer program product. Accordingly, certain embodiments may be implemented entirely as hardware, entirely as software (including firmware, resident software, micro-code, etc.) or as a combination of software and hardware (and other) aspects. Furthermore, certain embodiments may take the form of a computer program product on a computer-usable storage medium having computer-usable program code embodied in the medium.

Any suitable computer usable or computer readable medium may be utilized. The computer usable medium may be a computer readable signal medium or a computer readable storage medium. A computer-usable, or computer-readable, storage medium (including a storage device associated with a computing device or client electronic device) may be, for example, but is not limited to, an electronic, magnetic, optical, electromagnetic, infrared, or semiconductor system, apparatus, or device, or any suitable combination of the foregoing. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device. In the context of this document, a computer-usable, or computer-readable, storage medium may be any tangible medium that may contain, or store a program for use by or in connection with the instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be non-transitory and may be any computer readable medium that is not a computer readable storage medium and that may communicate, propagate, or transport a program for use by or in connection with an instruction execution system, apparatus, or device.

Aspects of certain embodiments are described herein may be described with reference to flowchart illustrations and/or block diagrams of methods, apparatus (systems) and computer program products according to embodiments of the invention. It will be understood that each block of any such flowchart illustrations and/or block diagrams, and combinations of blocks in such flowchart illustrations and/or block diagrams, may be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable memory that may direct a computer or other programmable data processing apparatus to function in a particular manner, such that the instructions stored in the computer-readable memory produce an article of manufacture including instructions which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks.

Any flowchart and block diagrams in the figures, or similar discussion above, may illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block (or otherwise described herein) may occur out of the order noted in the figures. For example, two blocks shown in succession (or two operations described in succession) may, in fact, be executed substantially concurrently, or the blocks (or operations) may sometimes be executed in the reverse order, depending upon the functionality involved. It will also be noted that each block of any block diagram and/or flowchart illustration, and combinations of blocks in any block diagrams and/or flowchart illustrations, may be implemented by special purpose hardware-based systems that perform the specified functions or acts, or combinations of special purpose hardware and computer instructions.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described in order to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. A method for adjusting a position of an implement of a work vehicle to control a load on the work vehicle, the implement movable by a hydraulic circuit controlled by a Grade Control System, the method comprising:

determining, by a processor of the work vehicle, a slip condition associated with the work vehicle;

determining, by the processor, an engine speed condition associated with the work vehicle by;

receiving a speed of the engine and a target speed of the engine from one or more sources associated with the work vehicle;

calculating, by the processor, a first speed error between the speed of the engine and the target speed;

determining, by the processor, whether the first speed error is greater than a threshold; and setting a first engine speed condition as true or false based on the determining;

determining, by the processor, an offset to adjust the position of the implement based on at least one of the slip condition and the engine speed condition;

outputting the offset to the Grade Control System to adjust the position of the implement based on the offset to control the load on the work vehicle;

based on the first engine speed condition as true, receiving a second speed of the engine from the one or more sources;

calculating, by the processor, a second speed error between the second speed of the engine and the target speed;

determining, by the processor, a direction of speed error of the engine based on the first speed error and the second speed error;

setting a second engine speed condition as true based on the determined direction; and determining the offset based on the second speed condition as true.

2. The method of claim 1, wherein the work vehicle has one or more wheels or tracks that are driven to move the work vehicle, and the determining, by the processor, the slip condition further comprises:

receiving speed data from a source that indicates a speed of a motor associated with at least one of the one or more wheels or tracks; and determining, by the processor, the slip condition based on the speed of the motor.

3. The method of claim 2, further comprising:

receiving ground speed data of the work vehicle from a source; and determining, by the processor, the slip condition based on a difference between the ground speed data and the speed of the motor.

4. The method of claim 1, further comprising:

receiving an operating state of the work vehicle;

determining, by the processor, a gain based on one or more predefined rates associated with the operating state of the work vehicle; and determining the offset based on the gain.

5. The method of claim 4, wherein the one or more predefined rates are user-defined via at least one input device associated with the work vehicle.

6. A system for adjusting a position of an implement of a work vehicle to control a load on the work vehicle, the implement movable by a hydraulic circuit controlled by a Grade Control System, the system comprising:

a controller associated with the work vehicle and having a processor that:

determines a slip condition associated with the work vehicle;

determines an engine speed condition associated with the work vehicle;

determines an offset to adjust the position of the implement based on the slip condition or the engine speed condition; and outputs the offset to the Grade Control System associated with the work vehicle to adjust the position of the implement to control the load on the work vehicle;

wherein the processor determines the engine speed condition based on a first speed error between a speed of the engine of the work vehicle and a target speed for the engine of the work vehicle;

wherein the processor sets a first engine speed condition as true or false based on whether the first speed error is greater than a threshold; and wherein based on the first engine speed condition as true, the processor calculates a second speed error between a second speed of the engine and the target speed for the engine, and the processor determines a direction of speed error of the engine based on the first speed error and the second speed error.

7. The system of claim 6, wherein the work vehicle has one or more tracks that are driven to move the work vehicle, and the processor determines the slip condition based on a speed of a motor associated with at least one of the tracks.

8. The system of claim 7, wherein the processor determines the slip condition based on a difference between a ground speed of the work vehicle and the speed of the motor.

9. The system of claim 6, wherein the processor sets a second engine speed condition as true based on the determined direction, and determines the offset based on the second engine speed condition as true.

10. The system of claim 6, wherein the processor receives an operating state of the work vehicle, determines a gain based on one or more predefined rates associated with the operating state of the work vehicle and determines the offset based on the gain.

11. A system for adjusting a position of an implement of a work vehicle to control a load on the work vehicle, the implement movable by a hydraulic circuit controlled by a Grade Control System, the work vehicle having one or more tracks that are driven to move the work vehicle, and the system comprising:

a controller associated with the work vehicle and having a processor that:

determines a slip condition associated with the work vehicle based on a difference between a ground speed of the work vehicle and a speed of a motor associated with at least one of the tracks;

determines an engine speed condition associated with the work vehicle;

determines an offset to adjust the position of the implement based on the slip condition or the engine speed condition; and outputs the offset to the Grade Control System to adjust the position of the implement to control the load on the work vehicle;

wherein the processor sets a first engine speed condition as true or false based on a difference between a speed of the engine of the work vehicle and a target speed for the engine of the work vehicle, and the first engine speed condition is true when the first speed error is greater than a threshold; and wherein based on the first engine speed condition as true, the processor calculates a second speed error between a second speed of the engine and the target speed for the engine, determines a direction of speed error of the engine based on the first speed error and the second speed error, and based on the determined direction, the processor sets a second engine speed condition as true and determines the offset based on the second engine speed condition as true.

12. The system of claim 11, wherein the processor receives an operating state of the work vehicle, determines a gain based on one or more predefined rates associated with the operating state of the work vehicle and calculates the offset based on the gain.

13. The system of claim 12, wherein the one or more predefined rates are user-defined via at least one input device associated with the work vehicle.

* * * * *